US009025995B2

(12) United States Patent
Yoshikawa

(10) Patent No.: US 9,025,995 B2
(45) Date of Patent: May 5, 2015

(54) IMAGE FORMING APPARATUS HAVING BELT CLEANING UNIT AND WASTE TONER CARTRIDGE CONNECTABLE TO EACH OTHER

(71) Applicant: Masanari Yoshikawa, Nagoya (JP)

(72) Inventor: Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/141,457

(22) Filed: Dec. 27, 2013

(65) Prior Publication Data

US 2014/0186070 A1 Jul. 3, 2014

(30) Foreign Application Priority Data

Dec. 27, 2012 (JP) ..... 2012-285968

(51) Int. Cl.
*G03G 15/16* (2006.01)
*G03G 21/12* (2006.01)

(52) U.S. Cl.
CPC ..... *G03G 21/12* (2013.01); *G03G 15/161* (2013.01); *G03G 2215/0132* (2013.01)

(58) Field of Classification Search
CPC ..... G03G 15/161; G03G 21/12; G03G 2215/0132
USPC ..... 399/101, 123
See application file for complete search history.

(56) References Cited

U.S. PATENT DOCUMENTS

| | | | | |
|---|---|---|---|---|
| 8,233,817 | B2 * | 7/2012 | Sakuma | 399/101 |
| 2010/0074646 | A1 * | 3/2010 | Miyahara et al. | 399/99 |
| 2013/0028632 | A1 | 1/2013 | Sato et al. | |
| 2013/0136488 | A1 * | 5/2013 | Yoshikawa | 399/101 |
| 2014/0037321 | A1 | 2/2014 | Sato | |
| 2014/0037322 | A1 | 2/2014 | Sato | |
| 2014/0186082 | A1 * | 7/2014 | Yoshikawa et al. | 399/358 |

FOREIGN PATENT DOCUMENTS

| | | | |
|---|---|---|---|
| JP | 2010-008472 | A | 1/2010 |
| JP | 2013-029755 | A | 2/2013 |

* cited by examiner

*Primary Examiner* — Ryan Walsh
(74) *Attorney, Agent, or Firm* — Chunhsi Andy Mu

(57) ABSTRACT

An image forming apparatus includes: a main casing; a belt unit having a belt and a belt cleaning unit; a waste toner container; and a supporting member supporting the waste toner container and a cartridge storing toner supplied to a photosensitive member. The supporting member in the main casing is movable between a contact position where the photosensitive member contacts the belt and a separation position where the photosensitive member separates from the belt. One of the waste toner container and the belt cleaning unit is movable between a connected position providing connection to each other and a disconnected position providing disconnection from each other when the support member is in the contact position. The supporting member moves between the contact position and the separation position when one of the waste toner container and the belt cleaning unit is in the disconnected position.

8 Claims, 10 Drawing Sheets

IMAGE FORMING APPARATUS HAVING BELT CLEANING UNIT AND WASTE TONER CARTRIDGE CONNECTABLE TO EACH OTHER

CROSS REFERENCE TO RELATED APPLICATION

This application claims priority from Japanese Patent Application No. 2012-285968 filed Dec. 27, 2012. The entire content of the priority application is incorporated herein by reference.

TECHNICAL FIELD

The present invention relates to an electro-photographic image forming apparatus that detachably accommodates a plurality of process cartridges therein.

BACKGROUND

Image forming devices that detachably accommodate a plurality of process cartridges are well-known in the art.

One of such printers includes a main body and an image forming unit detachably mountable in the main body. The image forming unit supports a plurality of process cartridges (for example, see Japanese Patent Application Publication No. 2010-008472).

In this printer, the image forming unit includes a waste toner box to store waste toner, and the main body includes a belt waste-toner conveying tube. The belt waste-toner conveying tube is configured to convey waste toner collected by a belt cleaning device to the waste toner box.

SUMMARY

In the above-described printer, the belt waste-toner conveying tube is fixed to the main body. On the other hand, the image forming unit, which includes the waste toner box, is configured to move relative to the main body. Specifically, the image forming unit is moved horizontally and then diagonally downward along an inclined portion to be positioned and accommodated in the main body. When accommodated in the main body, the waste toner box and the belt waste-toner conveying tube are connected to each other.

However, for accommodating the image forming unit in the main body, positioning of the image forming unit is performed while the image forming unit moves relative to the main body. Conceivably, under this construction, the waste toner box and the belt waste-toner conveying tube may be not connected to each other as intended. As a result, the waste toner collected by the belt cleaning device cannot be stored in the waste toner box.

In view of the foregoing, it is an object of the present invention to provide an image forming device which can ensure connection of a waste toner container and a belt cleaning unit.

In order to attain the above and other objects, there is provided an image forming apparatus configured to form a toner image on a photosensitive member. The image forming apparatus includes: a main casing; a belt unit having a belt and a belt cleaning unit configured to collect waste toner adhered to the belt; a waste toner container configured to store the waste toner collected by the belt cleaning unit; and a supporting member configured to support the waste toner container and a cartridge that stores toner to be supplied to the photosensitive member. The supporting member is configured to move between an internal position where the supporting member is inside the main casing and an external position where the supporting member is at least partly outside the main casing. The supporting member in the internal position is further configured to move between a contact position where the photosensitive member is in contact with the belt and a separation position where the photosensitive member is separated from the belt. One of the waste toner container and the belt cleaning unit is configured to move between a connected position providing connection between the waste toner container and the belt cleaning unit and a disconnected position providing disconnection between the waste toner container and the belt cleaning unit when the support member is in the contact position. The supporting member is configured to move between the contact position and the separation position when one of the waste toner container and the belt cleaning unit is in the disconnected position.

DETAILED DESCRIPTION

First Embodiment

A printer 1 as an example of an image forming apparatus according to a first embodiment of the present invention will be described with reference to FIGS. 1 through 5.

1. Overall Structure of the Printer

In the following description, directions related to the printer 1 will be given assuming that the printer 1 is resting on a horizontal flat surface. More specifically, the left side of the printer 1 in FIG. 1 will be considered the "front side", and the right side of the printer 1 in FIG. 1 will be considered the "rear side". Further, the near side in FIG. 1 will be considered the "right side", and the far side in FIG. 1 will be considered the "left side". A vertical direction in FIG. 1 will be referred to as an "up-down direction" with regard to the printer 1.

Figure 1:
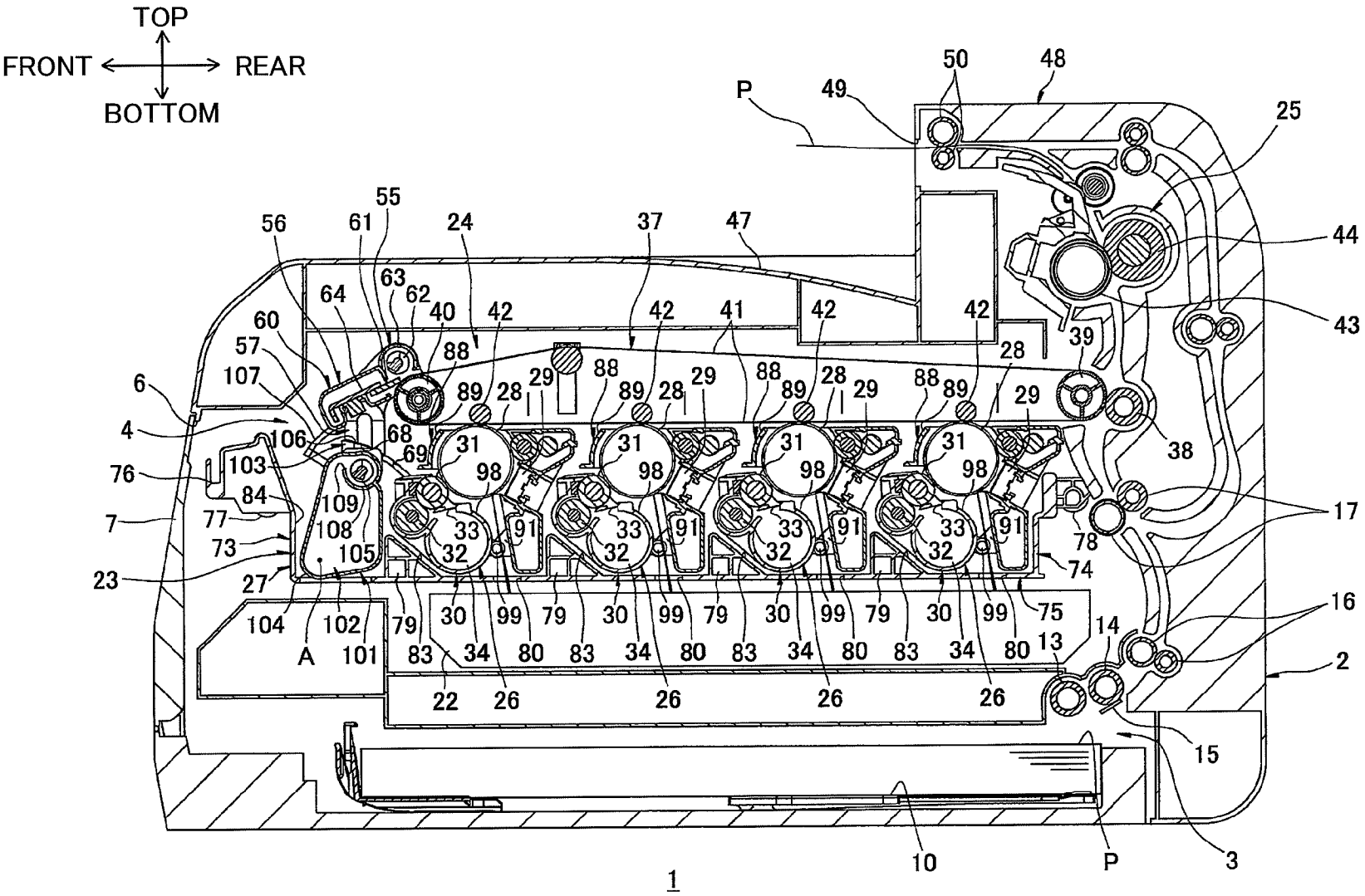
FIG. 1 is a central cross-sectional view of a printer as an example of an image forming apparatus according to a first embodiment of the present invention, the printer accommodating a process unit that includes a waste toner cartridge.

The printer 1 is a horizontal intermediate transfer type color printer. As shown in FIG. 1, the printer 1 includes a main casing 2 within which a sheet feeding unit 3 and image forming unit 4 are disposed. The sheet feeding unit 3 is configured to feed sheets P of paper. The image forming unit 4 is configured to form images on the sheets P fed from the sheet feeding unit 3.

(1) Main Casing

The main casing 2 is formed in a substantially rectangular box-like shape in a side view. The main casing 2 accommodates the sheet feeding unit 3 and the image forming unit 4. The main casing 2 has a front wall in which a main body aperture 6 is formed. A front cover 7 is pivotally movably provided on the front wall for covering and exposing the main body aperture 6. Specifically, the front cover 7 is pivotably movable about its lower end portion between a closed position shown in FIG. 1 for closing the main body aperture 6, and an open position shown in FIGS. 2 through 5 for opening the main body aperture 6.

(2) Sheet Feeding Unit

As show in FIG. 1, the sheet feeding unit 3 includes a sheet tray 10 which accommodates the sheets P of paper. The sheets P in the sheet tray 10 are conveyed between a sheet feed roller 14 and a sheet feed pad 15 by rotation of a pickup roller 13, and are separated into individual sheets P by the rotation of the sheet feed roller 14. Each sheet P thus separated then passes between pinch rollers 16 and is fed upward toward between a pair of registration rollers 17 by the rotation of the sheet feed roller 14. As the registration rollers 17 rotate, the sheet P is fed between an intermediate transfer belt 41 (described later) and a secondary transfer roller 38 (described later) provided in the image forming unit 4 with a prescribed timing.

(3) Image Forming Unit

The image forming unit 4 is disposed upward of the sheet feeding unit 3, and includes a scanner unit 22, a process unit 23, a transfer unit 24, and a fixing unit 25.

(3-1) Scanner Unit

The scanner unit 22 is disposed in a lower portion of the main casing 2, upward of the paper feed tray 10. The scanner unit 22 emits laser beams toward respective photosensitive drums 28 (described later), path of which are depicted by solid lines in FIG. 1, based on image data. The photosensitive drums 28 are thus exposed to light by the laser beams through exposure holes 80 formed on a process frame 27 (described later).

(3-2) Process Unit

The process unit 23 is disposed substantially in a center of the main casing 2 in the up-down (vertical) direction, upward of the scanner unit 22. When accommodated in the main casing 2 as shown in FIG. 1, the process unit 23 is positioned frontward of the registration rollers 17. More specifically, when accommodated in the main casing 2 (to be referred to as an "internal position" hereinafter), the process unit 23 is further configured to move in the up-down direction between a contact position (shown in FIGS. 1 to 3) and a separation position (shown in FIG. 4). When the process unit 23 is in the contact position, the photosensitive drums 28 are in contact with the intermediate transfer belt 41. In the separation position, the photosensitive drums 28 are separated from the intermediate transfer belt 41. Moreover, the process unit 23 is movable in a front-rear direction between the separation position and an external position shown in FIG. 5. In the external position, the process unit 23 is withdrawn from the main casing 2. That is, the process unit 23 is movable between the contact position and the separation position in the up-down direction when at the internal position, and the process unit 23 is further movable between the separation position and the external position in the front-rear direction.

The process unit 23 includes four process cartridges 26 corresponding to respective colors, and the process frame 27.

The process cartridges 26 are juxtaposedly arrayed and spaced away from one another in the front-rear direction (a pull-out direction). Each of the process cartridges 26 integrally holds the corresponding photosensitive drum 28, a Scorotron charger 29, and a developing device 30.

The photosensitive drums 28 are formed in a substantially cylindrical shape extending in a left-right direction.

The Scorotron charger 29 is disposed diagonally downward and rearward of the corresponding photosensitive drum 28 so as to oppose the same with a distance therebetween.

The developing device 30 is disposed downward and frontward of the corresponding photosensitive drum 28. Each developing device 30 includes a developing device frame 98 and a developing roller 31.

The developing roller 31 is rotatably supported to an upper end portion of the developing device frame 98. The developing roller 31 is exposed from the upper end portion of the developing device frame 98 to contact the corresponding photosensitive drum 28 from a lower front side thereof.

Each developing device 30 also includes a supply roller 32, a thickness regulating blade 33, and a toner accommodating chamber 34. The supply roller 32 is configured to supply toner to the corresponding developing roller 31. The thickness regulating blade 33 serves to regulate a thickness of the toner supplied to the developing roller 31. The toner accommodating chamber 34 is formed in the 98 rearward and downward of the supply roller 32 and severs to accommodate toner therein.

The process frame 27 detachably holds the four process cartridges 26. The process frame 27 is movable in the up-down direction within the main casing 2. Further, the process frame 27 is also configured to slide in the front-rear direction such that the process frame 27 can be accommodated in and withdrawn from the main casing 2.

(3-3) Transfer Unit

The transfer unit 24 is disposed in an upper portion of the main casing 2, upward of the process unit 23. The transfer unit 24 includes a belt unit 37 and the secondary transfer roller 38.

The belt unit 37 extends in the front-rear direction and is disposed upward of the process unit 23 in the contact position to oppose the photosensitive drums 28 from above. The belt unit 37 includes a driving roller 39, a following roller 40, the intermediate transfer belt 41, and four primary transfer rollers 42.

The driving roller 39 and the following roller 40 are disposed to oppose each other and are separated from each other in the front-rear direction. Specifically, the following roller 40 is disposed on a front end portion of the belt unit 37, and the driving roller 39 is disposed on a rear end portion of the belt unit 37.

The intermediate transfer belt 41 is mounted on and around the driving roller 39 and the following roller 40 in a taut state. The intermediate transfer belt 41 has a lower portion that can contact each of the photosensitive drums 28. As the driving roller 39 rotates, the lower portion of the intermediate transfer belt 41 is circularly moved rearward, and the following roller 40 is caused to rotate along with the circular movement of the intermediate transfer belt 41.

Each of the four primary transfer rollers 42 is provided to oppose the corresponding one of the photosensitive drums 28 with the lower portion of the intermediate transfer belt 41 interposed therebetween.

The secondary transfer roller 38 is provided rearward of the belt unit 37 such that the secondary transfer roller 38 opposes the driving roller 39 with the intermediate transfer belt 41 nipped therebetween.

(3-4) Fixing Unit

The fixing unit 25 is disposed upward of the secondary transfer roller 38. The fixing unit 25 includes a heating roller 43 and a pressure roller 44 opposing the heating roller 43.

(4) Image Forming Operation

The toner in the toner accommodating chamber 34 of each developing device 30 is supplied to the corresponding supply roller 32, and the supply roller 32 in turn supplies the toner to the corresponding developing roller 31.

The toner supplied onto the developing roller 31 is tribo-charged to a positive polarity between the supply roller 32 and the developing roller 31, as the developing roller 31 rotates. The thickness regulating blade 33 regulates a thickness of the toner carried on the developing roller 31, thereby maintaining the toner on the surface of the developing roller 31 at a thin layer with a uniform thickness.

Meanwhile, the Scorotron charger 29 applies a uniform charge to a surface of the corresponding photosensitive drum 28, as the photosensitive drum 28 rotates. Subsequently, the scanner unit 22 exposes the surface of the photosensitive drum 28 based on prescribed image data, thereby forming an electrostatic latent image on the surface of each photosensitive drum 28. The toner carried on each developing roller 31 is then supplied to the electrostatic latent image formed on the surface of the corresponding photosensitive drum 28, thereby a toner image being carried on the surface of the photosensitive drum 28.

The toner images carried on the surfaces of the photosensitive drums 28 are then sequentially transferred onto the lower portion of the intermediate transfer belt 41 that moves rearward while the intermediate transfer belt 41 circularly moves (primary transfer). A color image is thus formed on the lower portion of the intermediate transfer belt 41.

The color image formed on the intermediate transfer belt 41 is subsequently transferred onto the sheet P fed from the sheet feeding unit 3, as the sheet P passes between the intermediate transfer belt 41 and the secondary transfer roller 38 (secondary transfer).

The color image which has been transferred onto the sheet P is then thermally fixed thereon by heat and pressure while the sheet P passes between the heating roller 43 and the pressure roller 44.

(5) Sheet Discharge

The main casing 2 has an upper surface in which a discharge tray 47 is formed for receiving the image-formed sheet P. The main casing 2 has an upper-rear end portion from which a discharge unit 48 protrudes upward. The discharge unit 48 protrudes further upward than the discharge tray 47 in the up-down direction.

The discharge unit 48 includes a discharge outlet 49 through which the sheet P is discharged. The discharge outlet 49 is positioned higher than the discharge tray 47 in the up-down direction. The discharge unit 48 also includes two discharge rollers 50 adjacent to the discharge outlet 49 for discharging the sheet P to the discharge tray 47 through the discharge outlet 49.

The discharge rollers 50 rotate to convey the image-formed sheet P toward outside of the main casing 2 through the discharge outlet 49 to be finally received in the discharge tray 47.

2. Detailed Structure of the Belt Unit

The belt unit 37 includes a belt cleaning unit 55.

The belt cleaning unit 55 is provided on the front end portion of the belt unit 37. The belt cleaning unit 55 includes a belt cleaner 56 and a belt-side connecting part 57.

The belt cleaner 56 includes a belt cleaner frame 60, a blade member 61, and a belt-side auger 62.

The belt cleaner frame 60 is formed in a substantially box-like shape. As shown in FIG. 1, the belt cleaner frame 60 is disposed to confront the following roller 40 from above in an inclined state in a side view. Specifically, the belt cleaner frame 60 slopes diagonally frontward and downward from the front end portion of the belt cleaning unit 55. The belt cleaner frame 60 integrally includes an auger accommodating part 63 and a blade mounting part 64.

The auger accommodating part 63 occupies a rearward portion of the belt cleaner frame 60, the rearward portion constituting substantially one-third of the belt cleaner frame 60 in the front-rear direction. The auger accommodating part 63 is formed in a partial cylindrical shape extending in the left-right direction. The auger accommodating part 63 has a right end portion that is closed, and a left end portion that is in communication with the belt-side connecting part 57 as will be described later. The auger accommodating part 63 has a lower end portion that is open generally downward to oppose the following roller 40.

The blade mounting part 64 is formed frontward of the auger accommodating part 63 and constitutes substantially two-thirds of the belt cleaner frame 60 in the front-rear direction. The blade mounting part 64 is formed in a partial rectangular tube-like shape extending in the left-right direction, with both left and right end portions closed. The blade mounting part 64 has a rear lower portion that is open generally downward.

The blade member 61 is disposed on a rear end portion of the blade mounting part 64. The blade member 61 formed in a substantially plate-like shape extending in the left-right direction and has a thickness in the front-rear direction. The blade member 61 has a front end portion that is fixed to the rear end portion of the blade mounting part 64. The blade member 61 has a rear end portion (distal end portion) that is exposed from the blade mounting part 64. The rear end portion of the blade member 61 extends beneath the auger accommodating part 63 to confront the open lower end portion of the auger accommodating part 63. The rear end portion of the blade member 61 contacts the intermediate transfer belt 41 provided on a circumferential surface of the following roller 40 from upward and frontward thereof.

The belt-side auger 62 is an auger screw extending in the left-right direction. The belt-side auger 62 is disposed within the auger accommodation part 63. The belt-side auger 62 has a left end portion that is disposed within the belt-side connecting part 57 (described later).

The belt-side connecting part 57 is formed in a substantially cylindrical shape. The belt-side connecting part 57 extends leftward from the left end portion of the auger accommodation part 63, then bends downward and frontward, and then extends downward. In other words, the belt-side connecting part 57 is provided leftward (outward) of the left end portion of the auger accommodation part 63 in the left-right direction. The belt-side connecting part 57 has a lower end portion in which a belt-side communication port 68 is defined. The belt-side communication port 68 is substantially circular in bottom view. Interior and exterior of the belt cleaning unit 55 are in communication with each other through the belt-side communication port 68. The belt-side connecting part 57 includes a belt-side shutter 69.

The belt-side shutter 69 is formed in a substantially flat plate-like shape. The belt-side shutter 69 is slidably movable between an open position (shown in FIGS. 1 and 2) opening the belt-side communication port 68 and a closed position (shown in FIGS. 3 through 5) closing the closes the belt-side communication port 68. The belt-side shutter 69 is constantly biased toward the closed position by a biasing spring (not shown).

3. Detailed Structure of the Process Unit

The process unit 23 includes the process frame 27 and the four process cartridges 26. In addition, the process unit 23 includes a waste toner cartridge 101.

(1) Process Frame

The process frame 27 is formed in a substantially rectangular frame-like shape with a closed bottom in a plan view, as shown in FIG. 1. The process frame 27 includes a pair of side walls (not shown), a front wall 73, a rear wall 74, and a bottom wall 75.

The pair of side walls (not shown) is formed in a substantially rectangular plate-like shape in a side view, extending in the front-rear direction. The side walls are disposed in opposition to and in separation from each other in the left-right direction.

Figure 2:
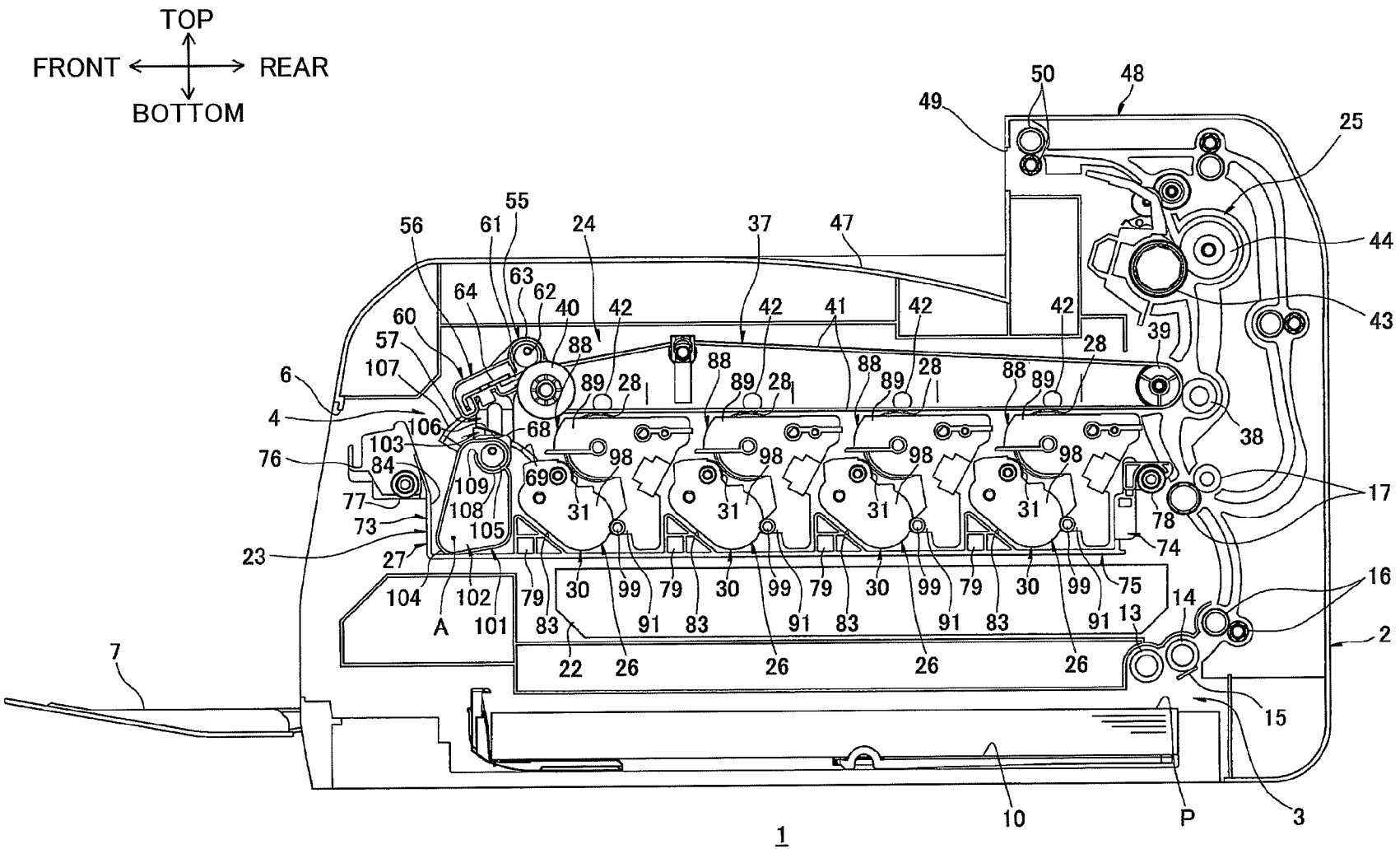
FIG. 2 is a view for explaining mounting and dismounting of the waste toner cartridge according to the first embodiment, wherein a front cover is in an open position, the waste toner cartridge is in a connected position, and the process unit is in a contact position.

The front wall 73 is formed in a substantially plate-like shape extending in the left-right direction. The front wall 73 is disposed to connect front end portions of the side walls. The front wall 73 has a front surface on which a grip part 76 is provided for a user to grasp the same. As shown in FIG. 2, the front wall 73 has a left and right end portions to which a front guide roller 77 is rotatably supported. The front guide roller 77 is formed in a substantially cylindrical shape extending in the left-right direction.

The front guide roller 77 is positioned lower than the belt-side connecting part 57 in the up-down direction the when the process unit 23 is accommodated in the main casing 2.

The rear wall 74 is formed in a substantially plate-like shape extending in the left-right direction and has a thickness in the front-rear direction. The rear wall 74 is disposed to bridge rear end portions of the not shown side walls. The rear wall 74 has left and right end portions to which a rear guide roller 78 is rotatably supported. The rear guide roller 78 is formed in a substantially cylindrical shape extending in the left-right direction.

The rear guide roller 78 is positioned lower than the belt-side connecting part 57 in the up-down direction when the process unit 23 is accommodated in the main casing 2.

The bottom wall 75 connects between lower end portions of the front wall 73 and the rear wall 74, and between lower end portions of the side walls (not shown) of the process frame 27. The bottom wall 75 is formed in a substantially rectangular shape in a plan view. The bottom wall 75 is formed with four partitioning walls 79 and the four exposure holes 80.

The four exposure holes 80 are aligned and spaced away from each other in the front-rear direction. Each of the exposure holes 80 has a substantially rectangular shape extending in the left-right direction in a plan view and penetrates through the bottom wall 75 in the up-down direction. up-down direction The four partitioning walls 79 are formed frontward of and separated from the respective four exposure holes 80. The partitioning walls 79 have a substantially right triangular shape in a side view. More specifically, each partitioning wall 79 protrudes upward from an upper surface of the bottom wall 75 and has a front surface extending in the up-down direction. Each partitioning wall 79 has left and right ends connected to the not illustrated side walls of the process frame 27.

In the process frame 27, four process cartridge accommodating sections 83 are defined by the four partitioning walls 79, the rear wall 74 and the side walls (not shown). Specifically, three spaces enclosed by the neighboring partitioning walls 79 and the side walls, and a space enclosed by the rearmost partitioning wall 79, the rear wall 74 and the side walls are defined as the process cartridge accommodating sections 83 for receiving the process cartridges 26.

Further, a space enclosed by the frontmost partitioning wall 79, the front wall 73, and the side walls of the process frame 27 is defined as a waste toner cartridge accommodating section 84 for receiving the waste toner cartridge 101.

Each process cartridge 26 is detachably accommodated in the corresponding process cartridge accommodating section 83. Each process cartridge 26 includes a drum unit 88 and the developing device 30.

Each drum unit 88 includes a drum frame 89.

Each drum frame 89 is formed in a substantially box-like shape whose top and bottom sides are open. Each drum frame 89 has side walls (left and right side walls) to which the corresponding photosensitive drum 28 is rotatably supported. The photosensitive drum 28 has top and bottom end portions exposed from the drum frame 89. Each drum frame 89 has a rear wall in which the corresponding Scorotron charger 29 is embedded. Each drum frame 89 includes a pair of drum-side engaging parts 91.

The drum-side engaging parts 91 are provided each on a lower end portion of each side wall of the corresponding drum frame 89. Each drum-side engaging part 91 has a substantially right triangular plate-like shape in a side view, extending frontward from the lower end portion of each side wall of the drum frame 89.

Each developing device 30 includes the developing device frame 98.

The developing device frame 98 is formed in a substantially box-like shape which is open diagonally upward and rearward. The developing device frame 98 has a pair of side walls to which the developing roller 31 and supply roller 32 are rotatably supported. The developing device frame 98 has a lower rear portion in which the toner accommodating chamber 34 is formed. The developing device frame 98 also includes a pair of developing-side engaging parts 99.

The developing-side engaging parts 99 are formed each on a lower end portion of each side wall of the developing device frame 98. The developing-side engaging parts 99 are in a substantially semicircular shape in a side view, extending rearward respectively from the lower end portions of the side walls of the developing device frame 98.

The developing-side engaging parts 99 and the drum-side engaging parts 91 are engaged with each other such that the developing roller 31 and the photosensitive drum 28 are in contact with each other. The developing device 30 and the drum unit 88 thus engaged with each other constitute the process cartridge 26. Further, the developing device 30 and the drum unit 88 are pivotably movable relative to each other about the developing-side engaging parts 99 and the drum-side engaging parts 91. Hence, when the process cartridge 26 is removed from the main casing 2, the developing roller 31 and the photosensitive drum 28 can contact and separate from each other.

In the process cartridge 26, the developing-side engaging parts 99 and the drum-side engaging parts 91 are engaged at positions outward of the photosensitive drum 28 in the left-right direction. The bottom end portion of the photosensitive drum 28 is thus exposed downward from the drum frame 89. Therefore, the laser beams from the scanner unit 22 can pass through the exposure holes 80 formed on the bottom wall 75 of the process frame 27 to expose the surfaces of the corresponding photosensitive drums 28 to light.

The waste toner cartridge 101 is detachably accommodated in the waste toner cartridge accommodating section 84. In other words, the waste toner cartridge 101 is disposed frontward of the frontmost process cartridge 26 in the process unit 23. The waste toner cartridge 101 includes a waste toner accommodating part 102 and an accommodating-side connecting part 103.

The waste toner accommodating part 102 includes an accommodating frame 104, an accommodating-side auger 105, and an auger partitioning wall 108.

The accommodating frame 104 is formed in a substantially box-like shape extending in the left-right direction and has an upper wall, a rear wall and a pair of side walls. The accommodating frame 104 has a substantially trapezoidal shape in a cross-sectional side view. The accommodating frame 104 has an upper portion whose left side wall is pierced in the left-right direction.

The accommodating-side auger 105 is an auger screw extending in the left-right direction and is rotatably disposed in the upper portion of the accommodating frame 104. The accommodating-side auger 105 has a left end disposed within the accommodating-side connecting part 103. As will be described later, the accommodating-side connecting part 103 is provided leftward of a left end portion of the upper portion of the accommodating frame 104 in the left-right direction.

The auger partitioning wall 108 connects between the pair of side walls of the accommodating frame 104. The auger partitioning wall 108 is formed in the upper portion of the accommodating frame 104. More specifically, the auger partitioning wall 108 extends frontward from an upper portion of the rear wall of the accommodating frame 104 and curves upward to have a substantially arcuate shape in a side cross-sectional view, in conformance with an outer profile of the accommodating-side auger 105.

An opening is thus defined by an upper-front peripheral edge of the auger partitioning wall 108, the upper wall and the pair of side walls of the accommodating frame 104. This opening serves as a waste toner leakage outlet 109 of the waste toner accommodating part 102.

The accommodating-side connecting part 103 has a substantially cylindrical shape, extending leftward from the left end portion on the upper portion of the accommodating frame 104 and then bending upward. The accommodating-side connecting part 103 has an upper end portion in which an accommodating-side communication port 106 is formed. The accommodating-side communication port 106 has a substantially cylindrical shape in a plan view. Interior and exterior of the waste toner cartridge 101 are in fluid communication with each other through the accommodating-side communication port 106.

The accommodating-side connecting part 103 also includes an accommodating-side shutter 107.

Figure 3:
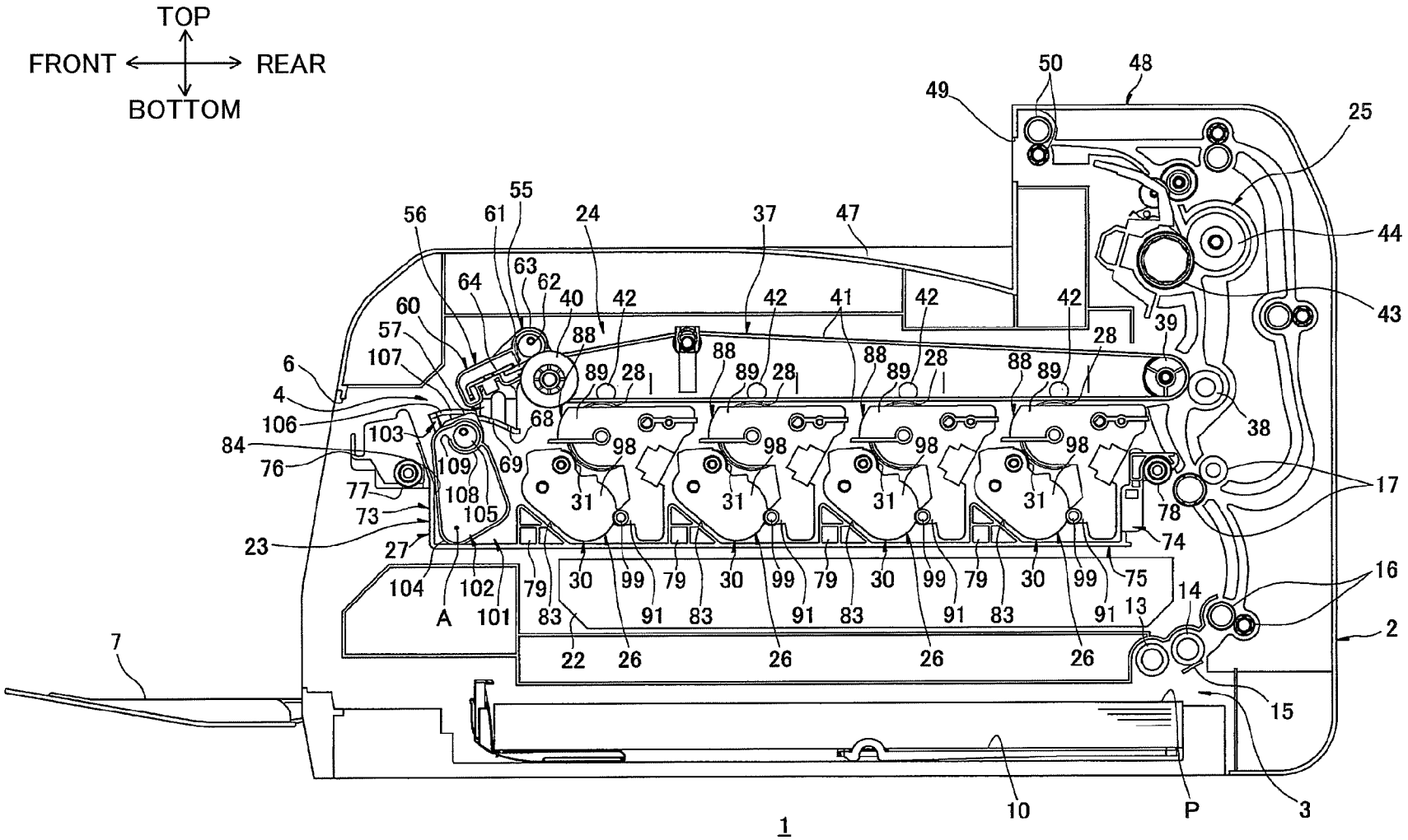
FIG. 3 is a view for explaining mounting and dismounting of the waste toner cartridge according to the first embodiment, wherein the front cover is in the open position, the waste toner cartridge is in a disconnected position, and the process unit is in the contact position.
Figure 4:
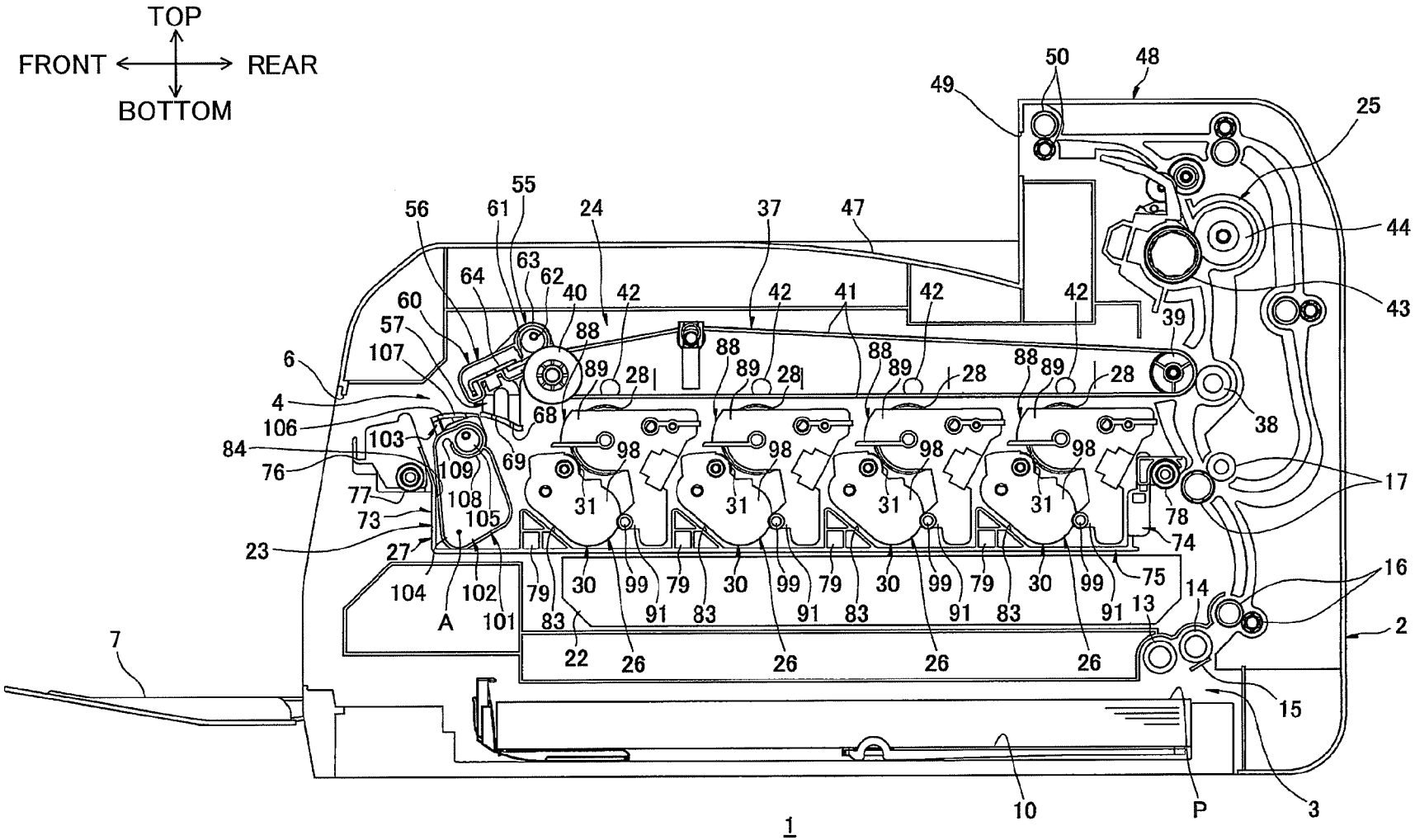
FIG. 4 is a view for explaining mounting and dismounting of the waste toner cartridge according to the first embodiment, wherein the front cover is in the open position, the waste toner cartridge is in the disconnected position, and the process unit is in a separation position.
Figure 5:
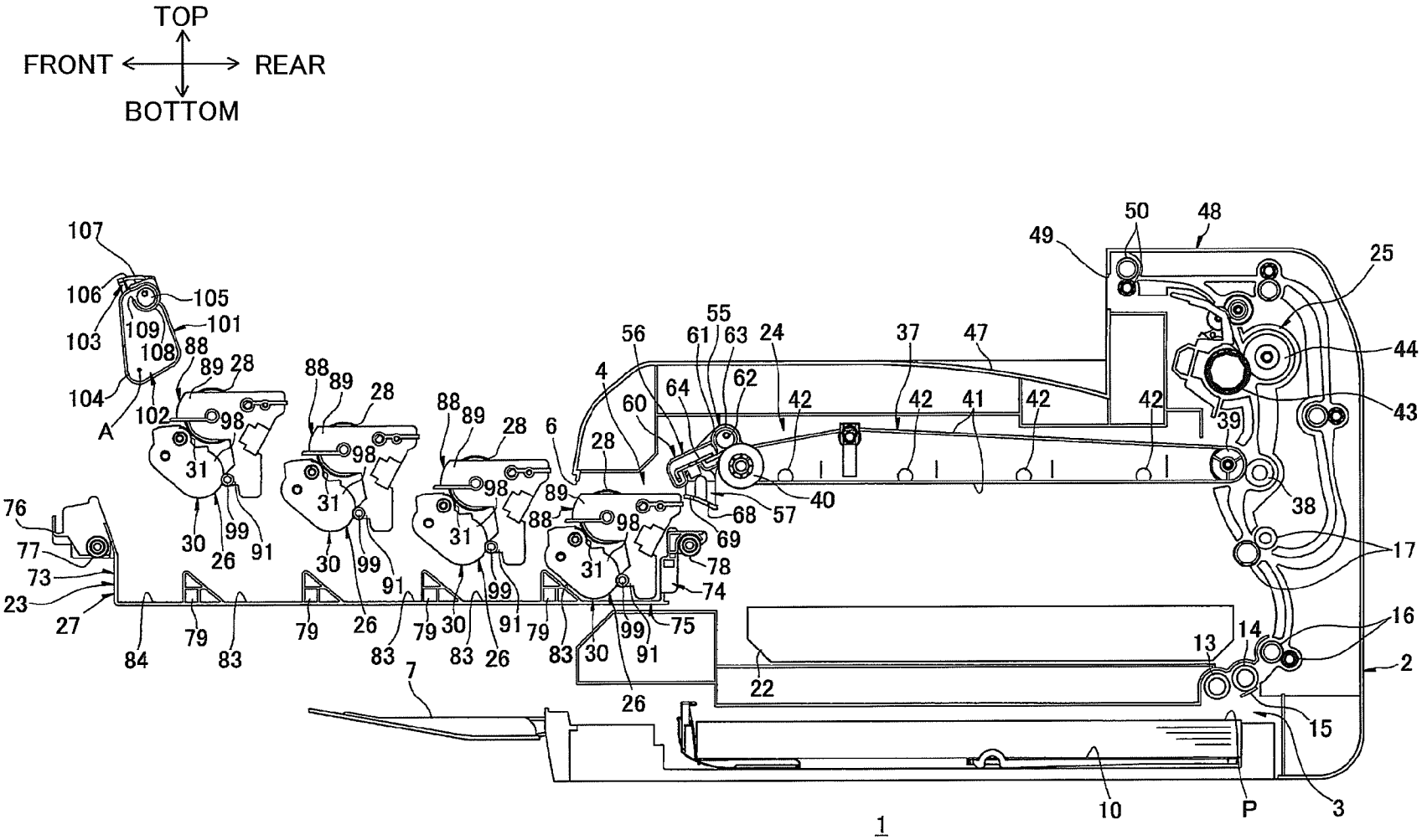
FIG. 5 is a view for explaining mounting and dismounting of the waste toner cartridge according to the first embodiment, wherein the front cover is in the open position, the waste toner cartridge is in a disconnected position, and the process unit is in an external position.

The accommodating-side shutter 107 is plate-like shaped and has a substantially L-shaped shape in a side view. The accommodating-side shutter 107 is pivotably movable, about a lower end portion thereof, between an open position and a closed position. The accommodating-side shutter 107 at the open position opens the accommodating-side communication port 106, as shown in FIGS. 1 and 2. The accommodating-side shutter 107 at the closed position closes the accommodating-side communication port 106, as shown in FIGS. 3 through 5. The accommodating-side shutter 107 is normally biased toward the closed position by a biasing spring (not shown).

The waste toner cartridge 101 has a lower front end portion in which a shaft is provided to define an axis A. The waste toner cartridge 101 is pivotably movable about the axis A when accommodated in the waste toner cartridge accommodating section 84.

The waste toner cartridge 101 is thus movable between a connected position and a disconnected position within the main casing 2. When the waste toner cartridge 101 is in the connected position, the accommodating-side communication port 106 opposes the belt-side communication port 68 of the belt cleaning unit 55 and is in fluid communication therewith, as shown in FIGS. 1 and 2. The waste toner cartridge 101 is thus connected to the belt cleaning unit 55 in the connected position. When the waste toner cartridge 101 is in the disconnected position, the accommodating-side communication port 106 is displaced frontward of the belt-side communication port 68 and the waste-toner cartridge 101 is disconnected from the belt cleaning unit 55, as shown in FIG. 3 through 5.

4. Process Unit Mounted in the Main Casing

In order to perform image formation, as shown in FIG. 1, the process unit 23 is disposed in the contact position within the main casing 2. When the process unit 23 is in the contact position, each of the photosensitive drums 28 is in contact with the intermediate transfer belt 41 from below.

Incidentally, the waste toner cartridge 101 is in the connected position. The accommodating-side communication port 106 of the accommodating-side connecting part 103 and the belt-side communication port 68 of the belt-side connecting part 57 are in communication with each other. At this time, the accommodating-side shutter 107 abuts on the belt-side connecting part 57 from its front side and is displaced to the open position against a biasing force of the biasing spring (not shown). The belt-side shutter 69 abuts on the accommodating-side connecting part 103 from its rear side and is displaced to the open position against a biasing force of the biasing spring (not shown).

The front cover 7 is in the closed position to close the main body aperture 6.

5. Operations for Collecting Materials Adhered to the Intermediate Transfer Belt During image forming operations, residual toner that has not been transferred onto the sheet P from each of the photosensitive drums 28 and paper dusts coming from the sheet P may be deposited on the intermediate transfer belt 41 that is in contact with the photosensitive drums 28. These foreign matters adhered to the intermediate transfer belt 41 (residual toner and paper dust) are scraped off by the blade member 61 that is in contact with the intermediate transfer belt 41, as the intermediate transfer belt 41 circularly moves. These matters scraped off from the intermediate transfer belt 41 are then collected into the auger accommodation part 63.

As the belt-side auger 62 rotates, the foreign materials collected into the auger accommodation part 63 are conveyed leftward within the auger accommodation part 63 and then to the belt-side connecting part 57. The foreign materials conveyed to the belt-side connecting part 57 fall downward, due to self-weight of the materials themselves, pass through the belt-side communication port 68 and the accommodating-side communication port 106, and come into the accommodating-side connecting part 103.

The foreign materials entering in the accommodating-side connecting part 103 are then conveyed rightward within the accommodating frame 104, by the rotation of the accommodating-side auger 105, following an upper surface of the auger partitioning wall 108. As conveyed rightward by the accommodating-side auger 105, the foreign materials partially leaks from the waste toner leakage outlet 109 and fall downward across an entire dimension thereof in the right-left direction within the accommodating frame 104.

In this way, the materials adhered to the intermediate transfer belt 41 are ultimately accumulated in the waste toner accommodating part 102 of the waste toner cartridge 101.

6. Attachment and Detachment of the Waste Toner Cartridge and the Process Cartridges In order to remove the waste toner cartridge 101 and the process cartridges 26 from the main casing 2, the process unit 23 is first pulled out to the external position.

In order to pull out the process unit 23 to the external position, an operator first pivotally moves the front cover 7 counterclockwise in a right side view to, moving the front cover 7 from the closed position to the open position to open the main body aperture 6, as shown in FIG. 2.

Next, the operator directly grasps the waste toner cartridge 101 and pivotably moves the waste toner cartridge 101 about the axis A in a counterclockwise direction in a right side view. In other words, the waste toner cartridge 101 functions as an example of a claimed operation part.

As the waste toner cartridge 101 is pivotally moved, the accommodating-side communication port 106 of the accommodating-side connecting part 103 is displaced frontward relative to the belt-side communication port 68 of the belt-side connecting part 57. The accommodating-side connecting part 103 and the belt-side connecting part 57 are thus disconnected to each other, as shown in FIG. 3.

At this time, in accordance with the pivotal movement of the waste toner cartridge 101, the accommodating-side shutter 107 is also moved to the closed position by the biasing force of the biasing spring (not shown). Also, the belt-side shutter 69 is moved forward to the closed position by the biasing force of the biasing spring (not shown). The belt-side communication port 68 is thus closed by the belt-side shutter 69.

The waste toner cartridge 101 is thus moved to the disconnected position.

Next, the operator grips the grip part 76 to move the process unit 23 downward, as shown in FIG. 4.

The operator's operation to move the process unit 23 downward causes the photosensitive drums 28 to be separated from the intermediate transfer belt 41. The process unit 23 is thus placed at the separation position.

Next, the operator pulls out the process unit 23 frontward from the main casing 2, while gripping the grip part 76.

The process unit 23 is thus moved to the external position, as shown in FIG. 5. As a result, the waste toner cartridge 101 and the process cartridges 26 are exposed from above.

The operator can now remove the waste toner cartridge 101 and the process cartridges 26 from the process unit 23.

For removing the waste toner cartridge 101 and the process cartridges 26 from the process unit 23, the operator can pull the waste toner cartridge 101 and the process cartridges 26 upward from the process unit 23.

In this way, maintenance and replacement of the waste toner cartridge 101 and the process cartridges 26 can be performed.

The detachment of the waste toner cartridge 101 and the process cartridges 26 from the main casing 2 is thus completed.

For mounting the waste toner cartridge 101 and the process cartridges 26 in the main casing 2, the steps described above should be performed in reverse.

Specifically, the waste toner cartridge 101 and the process cartridges 26 are mounted in the waste toner cartridge accommodating section 84 and the process cartridge accommodating sections 83 of the process frame 27, respectively, from above.

Next, the operator pushes the process unit 23 rearward to have the process unit 23 accommodated in the main casing 2, as shown in FIG. 4. The process unit 23 is thus placed at the separation position.

Then, grasping the grip part 76, the operator moves the process unit 23 upward, causing the photosensitive drums 28 to be brought into contact with the intermediate transfer belt 41, as shown in FIG. 3. The process unit 23 is thus moved to the contact position.

Next, the operator grasps and pivotally moves the waste toner cartridge 101 about the axis A in a clockwise direction in a right side view.

In accordance with the pivotal movement of the waste toner cartridge 101, the accommodating-side connecting part 103 abuts on the belt-side shutter 69 from frontward, and the belt-side shutter 69 is caused to move (slide) rearward against the biasing force of the biasing spring (not shown), as shown in FIG. 2. Meanwhile, the belt-side connecting part 57 abuts on the accommodating-side shutter 107 from its rear side to cause the accommodating-side shutter 107 to pivotally move forward against the biasing force of the biasing spring (not shown).

As the waste toner cartridge 101 is further pivotally moved, the accommodating-side communication port 106 of the accommodating-side connecting part 103 and the belt-side communication port 68 of the belt-side connecting part 57 oppose each other to establish fluid communication therebetween. The belt-side shutter 69 and the accommodating-side shutter 107 are at the respective open positions.

The waste toner cartridge 101 is thus positioned in the connected position.

Next, the operator pivotably moves the front cover 7 in the clockwise direction in a right side view for placing the front cover 7 in the closed position. The main body aperture 6 is closed accordingly, as shown in FIG. 1.

The attachment of the waste toner cartridge 101 and the process cartridges 26 to the main casing 2 is thus completed.

7. Operational and Technical Advantages (1) With the above-described structure of the printer 1 according to the first embodiment, the waste toner cartridge 101 is pivotably movable between the connected position and the disconnected position when the process unit 23 is placed at the contact position in the internal position. This means that the waste toner cartridge 101 can be moved to the connected position, after the process unit 23 and the photosensitive drums 28 are respectively positioned relative to the main casing 2. In other words, the accommodating-side connecting part 103 of the waste toner cartridge 101 and the belt-side connecting part 57 of the belt cleaning unit 55 can be brought into communication with each other after positioning of the process unit 23 and the photosensitive drums 28 are performed.

Further, the process unit 23 is in the contact position when the waste toner cartridge 101 is in the connected position, as shown in FIG. 1.

With this structure, since the waste toner cartridge 101 and the belt cleaning unit 55 are in communication with each other when the process unit 23 is in the contact position, materials adhered to the intermediate transfer belt 41 during image formation can be reliably collected. Moreover, since the waste toner cartridge 101 is operated after the process unit 23 is fixed in position relative to the main casing 2, operating the waste toner cartridge 101 can be carried out in a simple manner.

In order to placing the process unit 23 in the external position, the waste toner cartridge 101 is first pivotably moved from the connected position to the disconnected position when the process unit 23 is positioned at the contact position in the internal position, as shown in FIG. 3. Then, the process unit 23 is moved from the contact position to the separation position, as shown in FIG. 4. That is, the waste toner cartridge 101 is in the disconnected position when the process unit 23 is in the separation position.

This configuration realizes disconnection of the waste toner cartridge 101 and the belt cleaning unit 55 in a state where the process unit 23 and the photosensitive drums 28 are respectively fixed in position relative to the main casing 2, as shown in FIGS. 2 and 3. Hence, disconnection of the waste toner cartridge 101 and the belt cleaning unit 55 can be performed stably, although the waste toner cartridge 101 is provided in the process unit 23.

Further, the process unit 23 can be moved to the external position in a state where the photosensitive drums 28 are separated from the intermediate transfer belt 41, and the waste toner cartridge 101 is disconnected from the belt cleaning unit 55, as shown in FIGS. 4 and 5. This construction can prevent the accommodating-side connecting part 103 of the waste toner cartridge 101 and the belt-side connecting part 57 of the belt cleaning unit 55 from being damaged while the process unit 23 is moved (pulled out) to the external position from the separation position.

Further, as shown in FIGS. 2 and 3, since the waste toner cartridge 101 can be moved between the connected position and the disconnected position while the process unit 23 is placed at the contact position in the internal position, the accommodating-side connecting part 103 of the waste toner cartridge 101 and the belt-side connecting part 57 of the belt cleaning unit 55 can be reliably connected to each other.

(2) According to the printer 1 of the first embodiment, the waste toner cartridge 101 can be reliably pivotably moved between the connected position and the disconnected position as shown in FIGS. 2 and 3, since the operator directly grips and operates the waste toner cartridge 101.

(3) According to the printer 1 of the first embodiment, as shown in FIG. 5, the process unit 23 is pulled out frontward in the front-rear direction (also referred to as a pull-out direction). The waste toner cartridge 101 is exposed from the main casing 2 even sooner than the process cartridges 26 when the process unit 23 is moved toward the external position.

For this reason, the waste toner cartridge 101 can be detached from and attached to the process unit 23 in such a state that the process unit 23 is partially withdrawn from the main casing 2 and only the waste toner cartridge 101 is exposed from the main casing 2. Also, the operator can easily pivotably move the waste toner cartridge 101 between the connected position and the disconnected position, since the waste toner cartridge 101 is disposed most downstream in the pull-out direction in the process unit 23.

(4) According to the printer 1 of the first embodiment, as shown in FIGS. 3 and 4, the process unit supports the process cartridges 26 having the photosensitive drums 28. Thus the photosensitive drums 28 can be moved together with the process unit 23 when the process unit 23 is in the internal position.

Hence, the process unit 23 is reliably movable between the contact position at which the photosensitive drums 28 contact the intermediate transfer belt 41 and the separation position at which the photosensitive drums 28 separate from the intermediate transfer belt 41.

(5) According to the printer 1 of the first embodiment, as shown in FIGS. 3 and 4, even if the process unit 23 supports the plurality of process cartridges 26, the process unit 23 can reliably move between the contact position (the photosensitive drums 28 contact the intermediate transfer belt 41) and the separation position (the photosensitive drums 28 separate from the intermediate transfer belt 41).

8. Variation of the First Embodiment

In the first embodiment described above, for removing the waste toner cartridge 101 and the process cartridges 26 from the main casing 2, the front cover 7 is first moved to the open position and subsequently the waste toner cartridge 101 is manually moved to the disconnected position.

In contrast, as a variation of the first embodiment, the waste toner cartridge 101 may be moved to the disconnected position in conjunction with the operation to move the front cover 7 to the open position using a known linking mechanism.

With this configuration, the operation to open the front cover 7 and the movement (displacement) of the waste toner cartridge 101 from the connected position to the disconnected position can be mechanically linked to each other.

For this reason, the process unit 23 can be displaced to the external position after the waste toner cartridge 101 is reliably placed at the disconnected position.

Further, this configuration of the variation of the first embodiment can achieve the same technical advantages as the first embodiment.

Second Embodiment

Next, a waste toner cartridge 115 and a belt-side connecting part 124 according to a second embodiment of the present invention will be described with reference to FIGS. 6 through 10, wherein like parts and components are designated with the same reference numerals with those of the first embodiment to avoid duplicating description.

1. Configuration in the Second Embodiment

The belt cleaning unit 55 of the first embodiment includes the belt-side connecting part 57 that is incapable of moving relative to the belt cleaner 56, as shown in FIGS. 2 and 3. The process unit 23 of the first embodiment includes the waste toner cartridge 101 that is pivotally movable about the axis A between the connected position (connected to the belt cleaning unit 55) and the disconnected position (disconnected from the belt cleaning unit 55) when accommodated within the waste toner cartridge accommodating section 84.

Figure 6:
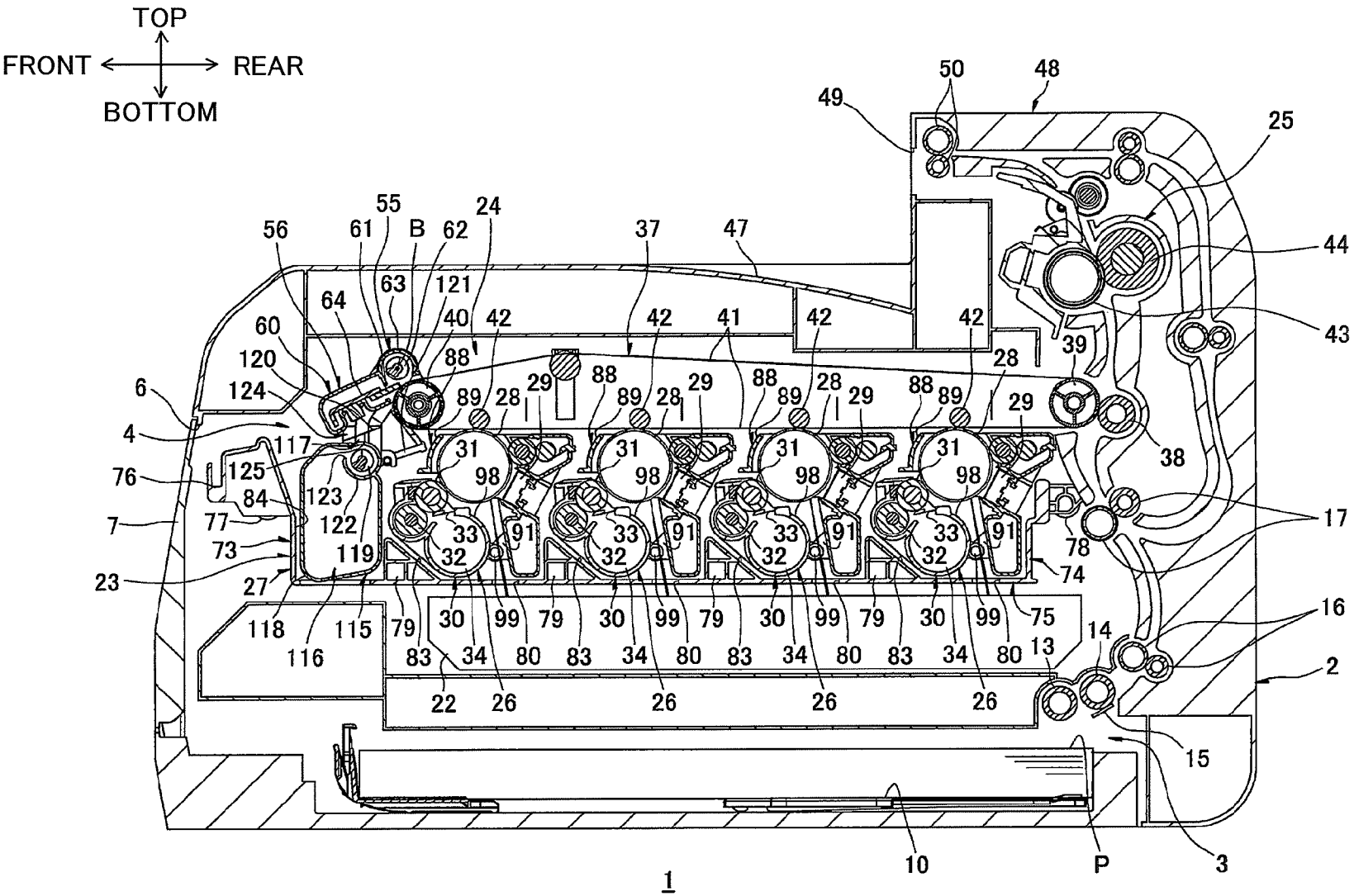
FIG. 6 is a central cross-sectional view of a printer as an example of an image forming apparatus according to a second embodiment of the present invention, the printer accommodating the process unit that includes a waste toner cartridge according to the second embodiment.

In contrast, in the second embodiment, the process unit 23 includes the waste toner cartridge 115. As shown in FIG. 6, unlike the waste toner cartridge 101 of the first embodiment, the waste toner cartridge 115 of the second embodiment cannot pivotally move when accommodated in the waste toner cartridge accommodating section 84. The belt cleaning unit 55 includes the belt-side connecting part 124 of the second embodiment that is pivotably movable about an axis B relative to the belt cleaner 56, the axis B being coincident with an axis of the belt-side auger 62.

The waste toner cartridge 115 is accommodated in the waste toner cartridge accommodating section 84. The waste toner cartridge 115 includes a waste toner accommodating part 116 and an accommodating-side connecting part 117.

The waste toner accommodating part 116 includes an accommodating frame 118, an accommodating-side auger 119, and an auger partitioning wall 122.

The accommodating frame 118 is formed in a substantially box-like shape extending in the left-right direction and has an upper wall, a rear wall and a pair of side walls. The accommodating frame 118 has a substantially rectangular shape in a side cross-sectional view. The accommodating frame 118 has an upper rear portion whose left side wall is pierced in the left-right direction.

The accommodating-side auger 119 is an auger screw extending in the left-right direction. The accommodating-side auger 119 is disposed in the upper rear portion of the accommodating frame 118. Moreover, the accommodating-side auger 119 has a left end disposed within the accommodating-side connecting part 117 (described later). The accommodating-side connecting part 117 is provided leftward of a left end portion of the accommodating frame 118 in the left-right direction.

The auger partitioning wall 122 connects between the pair of side walls of the accommodating frame 118. The auger partitioning wall 122 extends frontward from a front surface on an upper portion of the rear wall of the accommodating frame 118 and curving upward to have a substantially arcuate shape in a side cross-sectional view, in conformance with an outer profile of the accommodating-side auger 119.

Further, an opening is defined by an upper-front peripheral edge of the auger partitioning wall 122, the upper wall and the pair of side walls of the accommodating frame 118. This opening serves as a waste toner leakage outlet 123 of the waste toner accommodating part 116.

The accommodating-side connecting part 117 has a substantially cylindrical shape, extending leftward from the left end portion on the upper-rear portion of the accommodating frame 118 and then bending upward. The accommodating-side connecting part 117 has an upper end portion in which an accommodating-side communication port 120 is formed. The accommodating-side communication port 120 has a substantially circular shape in a plan view. Interior and exterior of the waste toner cartridge 115 are in fluid communication with each other through the accommodating-side communication port 120. The accommodating-side connecting part 117 includes an accommodating-side shutter 121.

Figure 7:
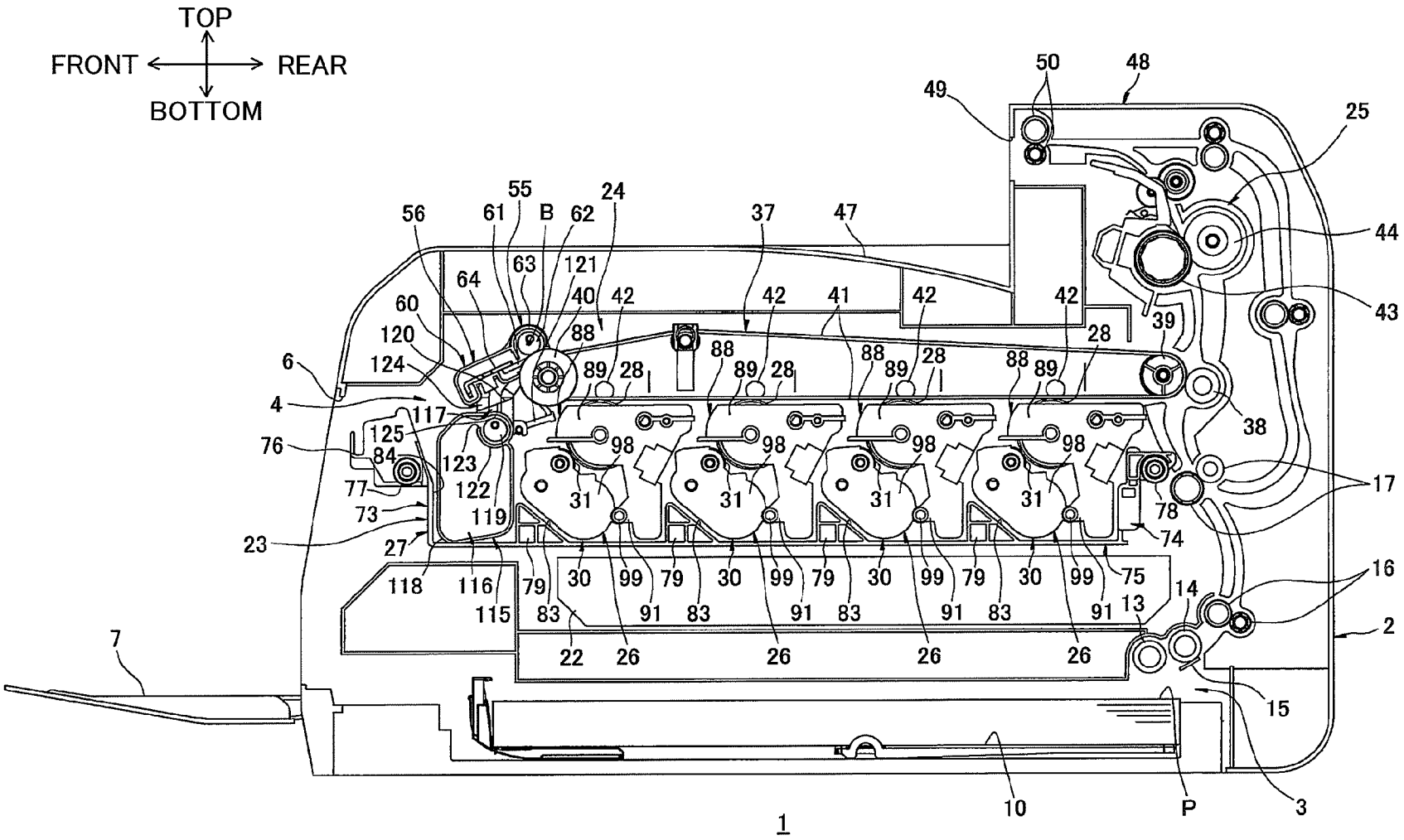
FIG. 7 is a view for explaining mounting and dismounting of the waste toner cartridge according to the second embodiment, wherein the front cover is in the open position, the waste toner cartridge is in a connected position, and the process unit is in the contact position.
Figure 8:
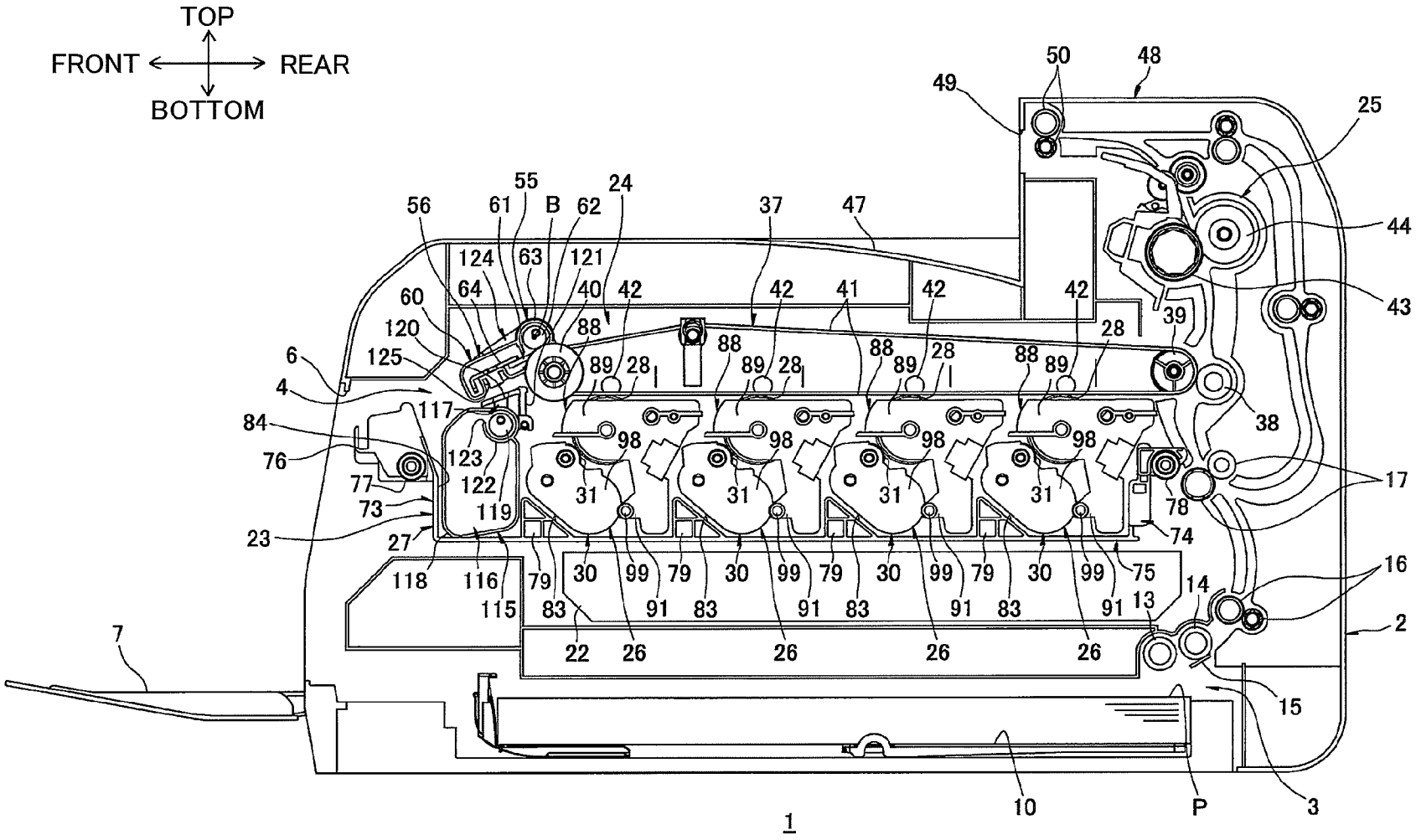
FIG. 8 is a view for explaining mounting and dismounting of the waste toner cartridge according to the second embodiment, wherein the front cover is in the open position, the waste toner cartridge is in a disconnected position, and the process unit is in the contact position.
Figure 9:
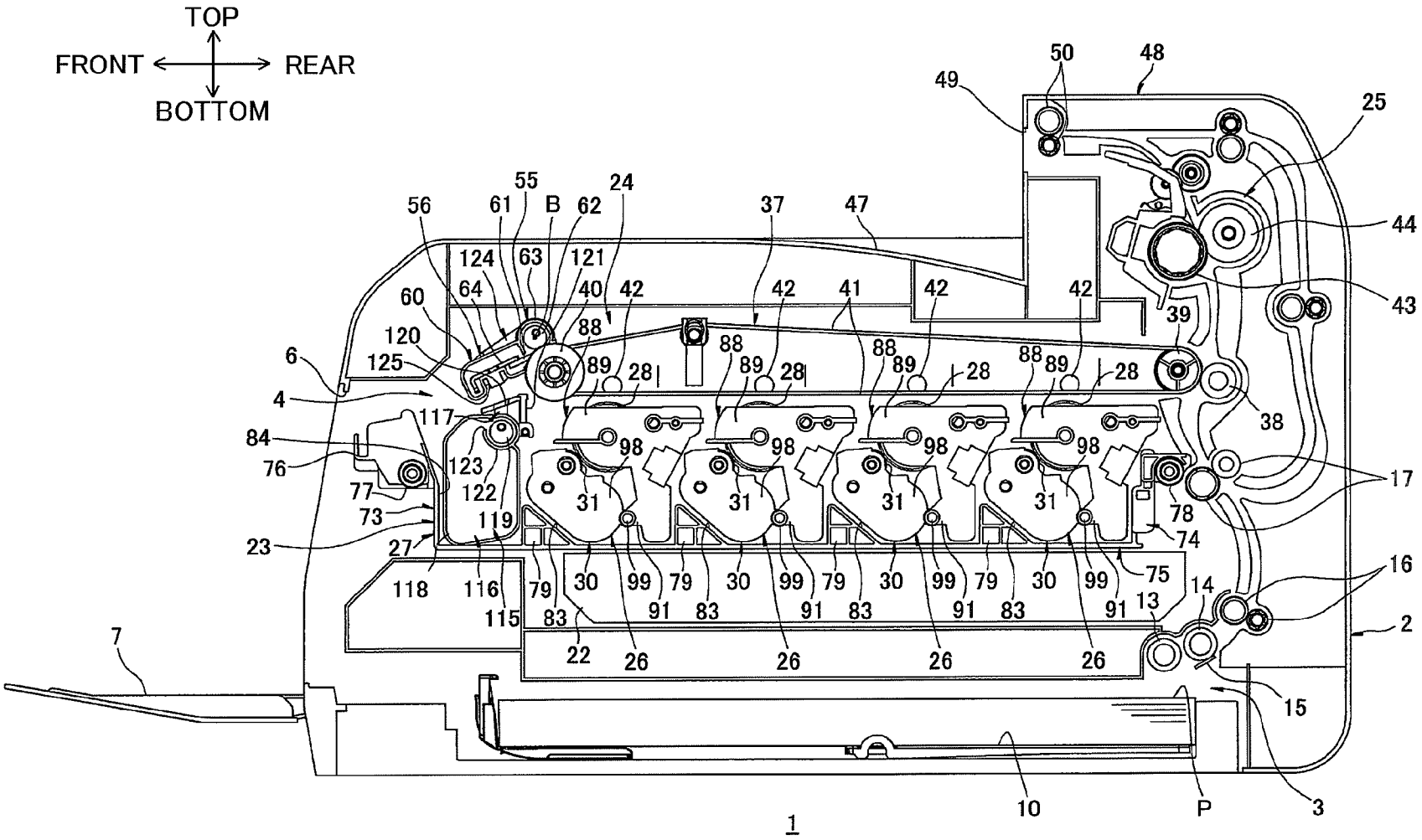
FIG. 9 is a view for explaining mounting and dismounting of the waste toner cartridge according to the second embodiment, wherein the front cover is in the open position, the waste toner cartridge is in the disconnected position, and the process unit is in the separation position.
Figure 10:
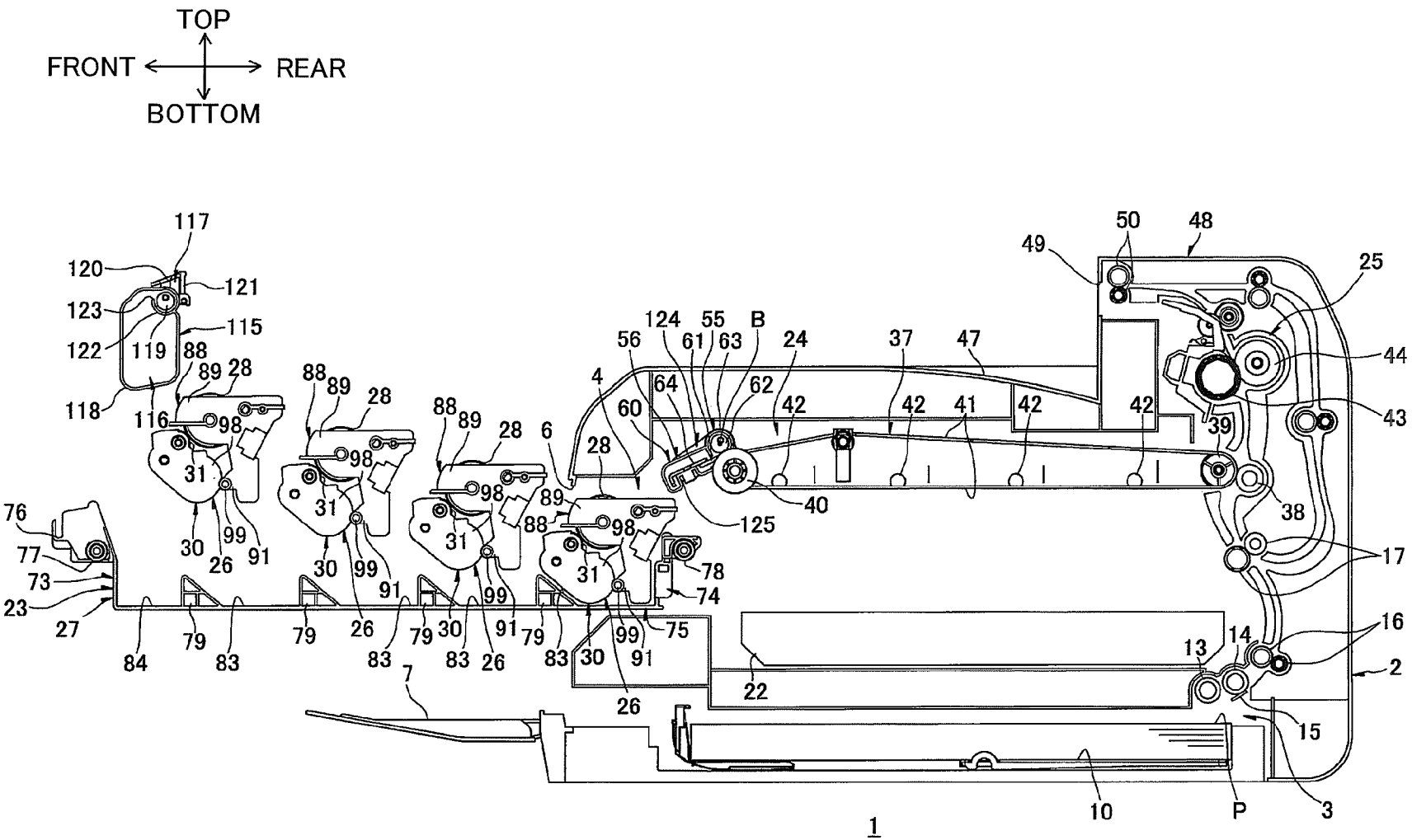
FIG. 10 is a view for explaining mounting and dismounting of the waste toner cartridge according to the second embodiment, wherein the front cover is in the open position, the waste toner cartridge is in the disconnected position, and the process unit is in the external position.

The accommodating-side shutter 121 is plate-like shaped and has a substantially L-shaped shape in a side view. The accommodating-side shutter 121 is pivotably movable, about a lower end portion thereof, between an open position and a closed position. The accommodating-side shutter 121 at the open position opens the accommodating-side communication port 120, as shown in FIGS. 6 and 7. The accommodating-side shutter 121 at the closed position closes the accommodating-side communication port 121, as shown in FIGS. 8 through 10.

The belt-side connecting part 124 has a substantially cylindrical shape. As shown in FIG. 6, the belt-side connecting part 124 extends leftward from the left end portion of the auger accommodation part 63 of the belt cleaner frame 60, then bends downward and frontward, and then extends downward. The belt-side connecting part 124 has a lower end portion in which a belt-side communication port 125 is formed. The belt-side communication port 125 has a substantially circular in a bottom view. Interior and exterior of the belt cleaning unit 55 are in fluid communication with each other through the belt-side communication port 125. The belt-side connecting part 124 is also provided with a belt-side shutter (not shown). The belt-side shutter is movable between an open position opening the belt-side communication port 125 and a closed position closing the belt-side communication port 125.

The belt-side connecting part 124 is pivotally movable about the axis B relative to the belt cleaner frame 60.

With this structure, the belt-side connecting part 124 is movable between a connected position and a disconnected position within the main casing 2. In the connected position, the belt-side connecting part 124 opposes the accommodating-side communication port 120 of the waste toner cartridge 115 and is in fluid communication therewith, as shown in FIGS. 6 and 7. The belt-side connecting part 124 is thus connected to the waste toner cartridge 115. In the disconnected position, the belt-side communication port 125 is moved frontward of the accommodating-side communication port 120 and the belt-side connecting part 124 is thus disconnected from the waste toner cartridge 115, as shown in FIG. 8 through 10.

Incidentally, the left end portion of the belt-side auger 62 (disposed within the auger accommodating part 63) is disposed within the belt-side connecting part belt-side connecting part 124.

2. Process Unit Mounted in the Main Casing in the Second Embodiment

As shown in FIG. 6, the process unit 23 is disposed in the contact position within the main casing 2. When the process unit 23 is in the contact position, each of the photosensitive drums 28 is in contact with the intermediate transfer belt 41 from below.

The belt-side connecting part 124 is in the connected position. Thus the belt-side communication port 125 of the belt-side connecting part 124 is in fluid communication with the accommodating-side communication port 120 of the accommodating-side connecting part 117 of the waste toner cartridge 115. At this time, the belt-side shutter (not shown) and the accommodating-side shutter 121 are both in the open position.

The front cover 7 is in the closed position. The main body aperture 6 is thus closed.

3. Operations for Collecting Materials Adhered to the Intermediate Transfer Belt in the Second Embodiment As described in the first embodiment, foreign matters adhered to the intermediate transfer belt 41 (such as residual toner and paper dust) are scraped off by the blade member 61 that is in contact with the intermediate transfer belt 41, as the intermediate transfer belt 41 circularly moves. These foreign matters scraped off from the intermediate transfer belt 41 are then collected into the belt-side connecting part 124 by the belt-side auger 62.

The foreign materials collected in the auger accommodation part 124 fall downward, due to self-weight of the materials themselves, pass through the belt-side communication port 125 and the accommodating-side communication port 120, and enters into the accommodating-side connecting part 117.

The foreign materials coming into the accommodating-side connecting part 117 are then conveyed rightward within the accommodating frame 118 by the rotation of the accommodating-side auger 119, following an upper surface of the auger partitioning wall 122. As conveyed rightward by the accommodating-side auger 119, the foreign materials partially leaks from the waste toner leakage outlet 123 and fall downward across an entire dimension thereof in the right-left direction within the accommodating frame 118.

The materials adhered to the intermediate transfer belt 41 are thus ultimately accumulated in the waste toner accommodating part 116 of the waste toner cartridge 115.

4. Attachment and Detachment of the Waste Toner Cartridge and the Process Cartridges in the Second Embodiment In order to remove the waste toner cartridge 115 and the process cartridges 26 from the main casing 2, the process unit 23 is first pulled out to the external position.

In order to pull out the process unit 23 to the external position, the operator pivotally moves the front cover 7 counterclockwise in a right side view to the open position to open the main body aperture 6, as shown in FIG. 7.

Next, the operator directly grasps the belt-side connecting part 124 and pivotably moves the belt-side connecting part 124 about the axis B in the counterclockwise direction in a right side view. In other words, the belt-side connecting part 124 functions as another example of the claimed operation part.

As the belt-side connecting part 124 is pivotally moved, the belt-side communication port 125 of the belt-side connecting part 124 is displaced frontward and upward relative to the accommodating-side communication port 120 of the accommodating-side connecting part 117 to be distanced therefrom, as shown in FIG. 8. The belt-side connecting part 124 is thus disconnected from the accommodating-side connecting part 117.

Then the operator moves the belt-side shutter (not shown) to the closed position to close the belt-side communication port 125. The operator also moves the accommodating-side shutter 121 to its closed position to close the accommodating-side communication port 120.

The belt-side connecting part 124 is thus displaced to the disconnected position from the connected position.

Subsequently, with the same procedures as the first embodiment, the operator moves the process unit 23 to the separation position, as shown in FIG. 9, and then to the external position, as shown in FIG. 10.

The waste toner cartridge 115 and the process cartridges 26 are then removed from the process unit 23.

To detach the waste toner cartridge 115 and the process cartridges 26 from the process unit 23, the operator pulls the waste toner cartridge 115 and the process cartridges 26 upward from the process unit 23.

Maintenance and replacement of the waste toner cartridge 115 and the process cartridges 26 can be performed.

The detachment of the waste toner cartridge 115 and the process cartridges 26 from the main casing 2 is thus completed.

In order to mount the waste toner cartridge 115 and the process cartridges 26 in the main casing 2, the steps described above are performed in reverse.

Specifically, the waste toner cartridge 115 and the process cartridges 26 are accommodated in the waste toner cartridge accommodating section 84 and the process cartridge accommodating sections 83 of the process frame 27, respectively, from above.

Next, with the same steps as in the first embodiment, the process unit 23 is moved to the separation position, as shown in FIG. 9, and to the contact position, as shown in FIG. 10.

The operator operates the belt-side shutter (not shown) to move the same to the open position to open the belt-side communication port 125. The operator also operates the accommodating-side shutter 121 to move the same to the open position to open the accommodating-side communication port 120.

Next, the operator pivotally moves the belt-side connecting part 124 about the axis B in the counterclockwise direction in a right side view.

The belt-side connecting part 124 is thus moved to the connected position.

Finally, as shown in FIG. 6, the front cover 7 of the main casing 2 is pivotably moved clockwise in a right side view to be displaced to the closed position to close the main body aperture 6.

The attachment of the waste toner cartridge 115 and the process cartridges 26 to the main casing 2 is thus completed.

5. Operational and Technical Advantages

According to the printer 1 of the second embodiment, as shown in FIGS. 7 and 8, the belt-side connecting part 124 can be pivotably moved between the connected position and the disconnected position when the process unit 23 is disposed at the contact position in the internal position. In other words, the belt-side connecting part 124 of the belt cleaning unit 55 can be connected to the accommodating-side connecting part 117 of the waste toner cartridge 115 to be in fluid communication therewith (i.e., the belt-side connecting part 124 is in the connected position) after the process unit 23 and the photosensitive drums 28 are respectively fixed in position relative to the main casing 2.

In other words, the process unit 23 is situated in the contact position when the belt-side connecting part 124 is in the connected position, as shown in FIG. 6.

With this structure, since the waste toner cartridge 115 and the belt cleaning unit 55 are in communication with each other when the process unit 23 is in the contact position, the materials adhered to the intermediate transfer belt 41 during image formation can be reliably collected. Moreover, since the waste toner cartridge 115 is operated after the process unit 23 is fixed relative to the main casing 2, the operator can easily manipulate the waste toner cartridge 115.

In order to moving the process unit 23 to the external position, the operator first moves the belt-side connecting part 124 from the connected position to the disconnected position when the process unit 23 is in the contact position of the internal position, as shown in FIG. 8. Then, the operator moves the process unit 23 from the contact position to the separation position, as shown in FIG. 9. That is, the belt-side connecting part 124 is in the disconnected position when the process unit 23 is in the separation position.

This configuration realizes disconnection of the waste toner cartridge 115 and the belt cleaning unit 55 in a state where the process unit 23 and the photosensitive drums 28 are respectively fixed in position relative to the main casing 2, as shown in FIGS. 7 and 8. Hence, disconnection of the waste toner cartridge 115 and the belt cleaning unit 55 can be performed stably, although the waste toner cartridge 115 is provided in the process unit 23.

Further, the process unit 23 can be moved (pulled out) to the external position from the separation position in a state where the photosensitive drums 28 are separated from the intermediate transfer belt 41 and the belt-side connecting part 124 of the belt cleaning unit 55 is disconnected from the accommodating-side connecting part 117 of the waste toner cartridge 115, as shown in FIGS. 9 and 10. This construction can prevent the accommodating-side connecting part 117 and the belt-side connecting part 124 from being damaged while the process unit 23 is pulled out to the external position.

Further, as shown in FIGS. 7 and 8, since the belt-side connecting part 124 can be displaced between the connected position and the disconnected position while the process unit 23 is placed at the contact position in the internal position, the belt-side connecting part 124 of the belt cleaning unit 55 can be reliably connected to the accommodating-side connecting part 117 of the waste toner cartridge 115.

Further, the construction of the second embodiment can realize the same operational and technical advantages as in the first embodiment.

6. Variation of the Second Embodiment

In the above-described second embodiment, for removing the waste toner cartridge 115 and the process cartridges 26 from the main casing 2, the front cover 7 is first moved to the open position and subsequently the belt-side connecting part 124 is manually moved to the disconnected position.

In contrast, as a variation of the second embodiment, the belt-side connecting part 124 may be moved to the disconnected position in conjunction with the operation to move the front cover 7 to the open position using a known linking mechanism.

With this configuration, as shown in FIGS. 6 and 8, the operation to open the front cover 7 and the movement (displacement) of the belt-side connecting part 124 from the connected position to the disconnected position can be mechanically linked to each other.

Therefore, the process unit 23 can be moved to the external position after the belt-side connecting part 124 is reliably placed in the disconnected position.

The configuration of the variation of the second embodiment also realizes the same operational and technical advantages as in the second embodiment.

While the invention has been described in detail with reference to the specific embodiment thereof, it would be apparent to those skilled in the art that various changes and modifications may be made therein without departing from the spirit of the invention.

What is claimed is:

1. An image forming apparatus configured to form a toner image on a photosensitive member, the image forming apparatus comprising:

a main casing;

a belt unit having a belt and a belt cleaning unit configured to collect waste toner adhered to the belt;

a waste toner container configured to store the waste toner collected by the belt cleaning unit; and a supporting member configured to support the waste toner container and a cartridge that stores toner to be supplied to the photosensitive member, the supporting member being configured to move between an internal position where the supporting member is inside the main casing and an external position where the supporting member is at least partly outside the main casing, wherein the supporting member in the internal position is further configured to move between a contact position where the photosensitive member is in contact with the belt and a separation position where the photosensitive member is separated from the belt, wherein one of the waste toner container and the belt cleaning unit is configured to move between a connected position providing connection between the waste toner container and the belt cleaning unit and a disconnected position providing disconnection between the waste toner container and the belt cleaning unit when the supporting member is in the contact position, and wherein the supporting member is configured to move between the contact position and the separation position when one of the waste toner container and the belt cleaning unit is in the disconnected position.

2. The image forming apparatus as claimed in claim 1, wherein one of the waste toner container and the belt cleaning unit functions as an operation part for providing movement from the connected position to the disconnected position.

3. The image forming apparatus as claimed in claim 1, wherein the waste toner container is configured to move between the connected position and the disconnected position.

4. The image forming apparatus as claimed in claim 1, wherein the belt cleaning unit is configured to move between the connected position and the disconnected position.

5. The image forming apparatus as claimed in claim 4, wherein the belt cleaning unit comprises:

a belt cleaner configured to collect the waste toner from the belt; and a connecting part configured to move relative to the belt cleaner and connectable to the waste toner container, the connecting part functioning as an operation part to move the belt cleaning unit between the connected position and the disconnected position.

6. The image forming apparatus as claimed in claim 1, wherein the belt is positioned upward of the photosensitive member when the supporting member is in the internal position;

wherein the waste toner container is detached from and attached to the supporting member; and wherein the supporting member moves in a first direction from the internal position to the external position while supporting the waste toner container and the cartridge, the waste toner container being positioned downstream of the cartridge in the first direction.

7. The image forming apparatus as claimed in claim 1, wherein the cartridge is configured to accommodate the photosensitive member therein.

8. The image forming apparatus as claimed in claim 1, wherein the main casing is formed with an aperture through which the supporting member moves between the internal position and the external position relative to the main casing, the main casing further comprising a cover configured to move between an open position and a closed position, the cover in the open position opening the aperture and the cover in the closed position closing the aperture, wherein one of the waste toner container and the belt cleaning unit is configured to move from the connected position to the disconnected position in conjunction with movement of the cover from the closed position to the open position.

* * * * *